US011656041B1

(12) United States Patent
Millard et al.

(10) Patent No.: US 11,656,041 B1
(45) Date of Patent: May 23, 2023

(54) UNFINISHED FIREARM

(71) Applicant: Vigilant Gear, LLC, Priest River, ID (US)

(72) Inventors: Lowell Millard, Priest River, ID (US); Zachary Carlson, Priest River, ID (US); John Mckenna Meehan, Suwanee, GA (US)

(73) Assignee: Vigilant Gear, LLC, Priest River, ID (US)

( * ) Notice: Subject to any disclaimer, the term of this patent is extended or adjusted under 35 U.S.C. 154(b) by 0 days.

(21) Appl. No.: 17/533,690

(22) Filed: Nov. 23, 2021

Related U.S. Application Data

(60) Provisional application No. 63/117,816, filed on Nov. 24, 2020.

(51) Int. Cl.
*F41A 3/66* (2006.01)
*F41C 3/00* (2006.01)

(52) U.S. Cl.
CPC . *F41A 3/66* (2013.01); *F41C 3/00* (2013.01)

(58) Field of Classification Search
CPC ..... F41A 3/66; F41A 11/00; F41C 3/00
See application file for complete search history.

(56) References Cited

U.S. PATENT DOCUMENTS

| | | | |
|---|---|---|---|
| 6,560,909 B2 | 5/2003 | Cominolli | |
| 6,601,331 B2 | 8/2003 | Salvitti | |
| 7,690,144 B2 | 4/2010 | Fagundes de Campos | |
| 8,046,948 B2 | 11/2011 | Mauch | |
| 8,959,819 B2 | 2/2015 | Jones | |
| 9,970,726 B1 | 5/2018 | Hubert | |
| 10,612,870 B2 | 4/2020 | Borges | |
| 10,739,090 B2 | 8/2020 | Borges | |
| 2003/0213159 A1 | 11/2003 | Cutini | |
| 2017/0350665 A1* | 12/2017 | Borges | F41A 19/11 |
| 2018/0328681 A1 | 11/2018 | Borges | |
| 2019/0024996 A1 | 1/2019 | Borges | |
| 2019/0154368 A1* | 5/2019 | Kim | F41A 11/02 |
| 2020/0217604 A1 | 7/2020 | Borges | |
| 2020/0292255 A1 | 9/2020 | Borges | |

FOREIGN PATENT DOCUMENTS

| | | |
|---|---|---|
| CA | 2444058 | 10/2004 |
| EP | 1443295 | 8/2004 |

OTHER PUBLICATIONS

U.S. Appl. No. 63/106,746, filed Oct. 28, 2020 titled Safety Selector Assembly for a Firearm.
U.S. Appl. No. 63/106,761, filed Oct. 28, 2020 titled Firearm and Method of Teaching Use.
U.S. Appl. No. 63/117,816, filed Nov. 24, 2020 titled Unfinished Firearm.
U.S. Appl. No. 17/511,640, filed Oct. 27, 2021 titled Safety Selector Assembly for a Firearm.

* cited by examiner

*Primary Examiner* — J. Woodrow Eldred
(74) *Attorney, Agent, or Firm* — Dinsmore & Shohl LLP

(57) ABSTRACT

Present embodiments relate to an unfinished firearm. More specifically, but without limitation, present embodiments relate to an unfinished firearm frame which may be constructed to define a useable firearm.

9 Claims, 8 Drawing Sheets

UNFINISHED FIREARM

CROSS REFERENCE TO RELATED APPLICATION

This non-provisional patent application claims priority to and benefit of, under 35 U.S.C. § 119(e), U.S. Provisional Patent Application Ser. No. 63/117,816, filed Nov. 24, 2020 and titled "Unfinished Firearm", all of which is incorporated by reference herein.

BACKGROUND

1. Field of the Invention

Present embodiments relate to an unfinished firearm. More specifically, but without limitation, present embodiments relate to an unfinished firearm frame which may be constructed to define a useable firearm.

2. Description of the Related Art

The assembly of firearms by the consumer is an area which is growing. Similar to aftermarket auto parts or automotive modification for personalization, firearms owners have an increasing desire to assemble their firearms, as well as personalize the firearms in whatever manner they choose.

The purchase of an unfinished firearm, or portion of a firearm is a growing hobby area. Firearms owners have various parts which are popular replacement items for fully functioning guns they may buy. For example, sight, optics, triggers, barrels, and magazine bases are just some popular items which are often replaced. Thus, starting with an unfinished firearm allows firearm users to buy only the parts they want, rather than pay for parts they are likely going to replace.

Under Federal gun laws, certain parts of a firearm must be serialized. However, if the part is less than 80% complete, the part may not need to be serialized. Therefore, the part may be classified differently, as a non-firearm, and may be sold without violating Federal firearm laws. For some buyers, it is also desirable to purchase the parts in order that the firearm is not registered under normal registration processes.

It may be desirable to provide an unfinished firearm part which meets these goals and allows for customization and avoidance of buying undesirable parts which occurs when purchasing a finished firearm.

The information included in this Background section of the specification, including any references cited herein and any description or discussion thereof, is included for technical reference purposes only and is not to be regarded subject matter by which the scope of the invention is to be bound.

SUMMARY

The present application discloses one or more of the features recited in the appended claims and/or the following features which alone or in any combination, may comprise patentable subject matter.

The present embodiments provide an unfinished firearm frame for a firearm frame subassembly. The frame body may be finished in order to function with other components to define a firearm. The unfinished frame includes a stencil which is applied to and located relative to the unfinished frame, in order to locate stencil holes to drill through holes in the frame. Additionally, obstructions or impediments are disposed in the unfinished frame, which preclude either or both of positioning or movement of certain additional components necessary for operation. Slide rails should also be installed in the frame in order to accommodate a slide. The stencil may be used in an alternative orientation to apply pressure to, and retain the rail slides, while an adhesive or epoxy cures.

According to some embodiments, an unfinished frame subassembly may comprise a body including a grip, a trigger guard, and an upper portion capable of receiving a slide upon further machining adjacent to an upper edge of the upper portion, the upper portion including a forward portion having a forward receptacle and a rearward portion having a forward receptacle, a first pair of pockets disposed adjacent to the rearward receptacle, each pocket of the first pair of pockets capable of receiving a rear slide rail, a second pair of pockets disposed adjacent to the forward receptacle, each pocket of the second pair of pockets capable of receiving a forward slide rail, a cap which is disposed in each of the pockets, the cap retaining each of the rear and forward slide rails.

According to some optional embodiments, the following embodiments may be utilized with the unfinished frame subassembly or may be used in combination with other optional embodiments as well as the unfinished frame subassembly. One of the pockets or the rear and forward slide rails may have one or more locating apertures. The other of the pockets or the rear and forward slide rails may have one or more locating pins corresponding to the one or more locating apertures. Each of the pockets may have a first width and a second width defining a keyway. The second width may receive keys of each of the slide rails, to limit vertical motion of the rear and forward slide rails, when disposed in each of the pockets. The forward receptacle having one or more removable obstructions. The one or more removable obstructions of the forward receptacle configured to allow receipt of a guide rod and recoil spring. The one or more removable obstructions may inhibit installation or operation of the slide. The subassembly may require fabrication in order to function.

According to another embodiment, an unfinished frame subassembly may comprise a body including a grip, a trigger guard, and an upper portion capable of receiving a slide adjacent to an upper edge of the upper portion, a stencil having a first side, a second side and a joining span extending between the first side and the second side, the stencil having an open interior capable of receiving at least a portion of the upper portion of the body, a plurality of apertures located along the stencil for locating holes to be drilled in the unfinished frame.

According to some optional embodiments, the following embodiments may be utilized with the unfinished frame subassembly or may be used in combination with other optional embodiments as well as the unfinished frame subassembly. The unfinished frame may further comprise pockets. The stencil may further comprise lugs which are capable of being positioned in pockets of the unfinished frame, to locate the stencil relative to the unfinished frame.

According to another embodiment a method of constructing a firearm frame may comprise the steps of: positioning a stencil on an unfinished firearm frame, drilling at least one hole in the unfinished firearm frame through the stencil, removing the stencil, positioning rear rail slides in each of rearward pockets in the unfinished firearm frame, positioning forward rail slides in each of forward pockets in the unfinished firearm frame, adhering the rear and forward rail slides in the rearward and forward pockets, respectively, applying caps into the pockets and capturing the rear and forward rail slides in position.

According to some optional embodiments, the following embodiments may be utilized with the method or may be used in combination with other optional embodiments as well as the method. The method may further comprise removing obstructions located in receptacles of the unfinished firearm frame. The method may further comprise changing the orientation of the stencil on the unfinished firearm frame. The method may further comprise the drilling a hole in the unfinished firearm frame through said stencil being for a trigger pin. The method may further comprise positioning a cap in the forward pockets and capturing the forward rail slides. The method may further comprise positioning the cap in the rearward pockets and capturing the rear rail slides.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

BRIEF DESCRIPTION OF THE DRAWINGS

In order that the embodiments may be better understood, embodiments of an unfinished firearm will now be described by way of examples. These embodiments are not to limit the scope of the claims as other embodiments of an unfinished firearm will become apparent to one having ordinary skill in the art upon reading the instant description. Non-limiting examples of the present embodiments are shown in figures wherein:

DETAILED DESCRIPTION

Figure 1:
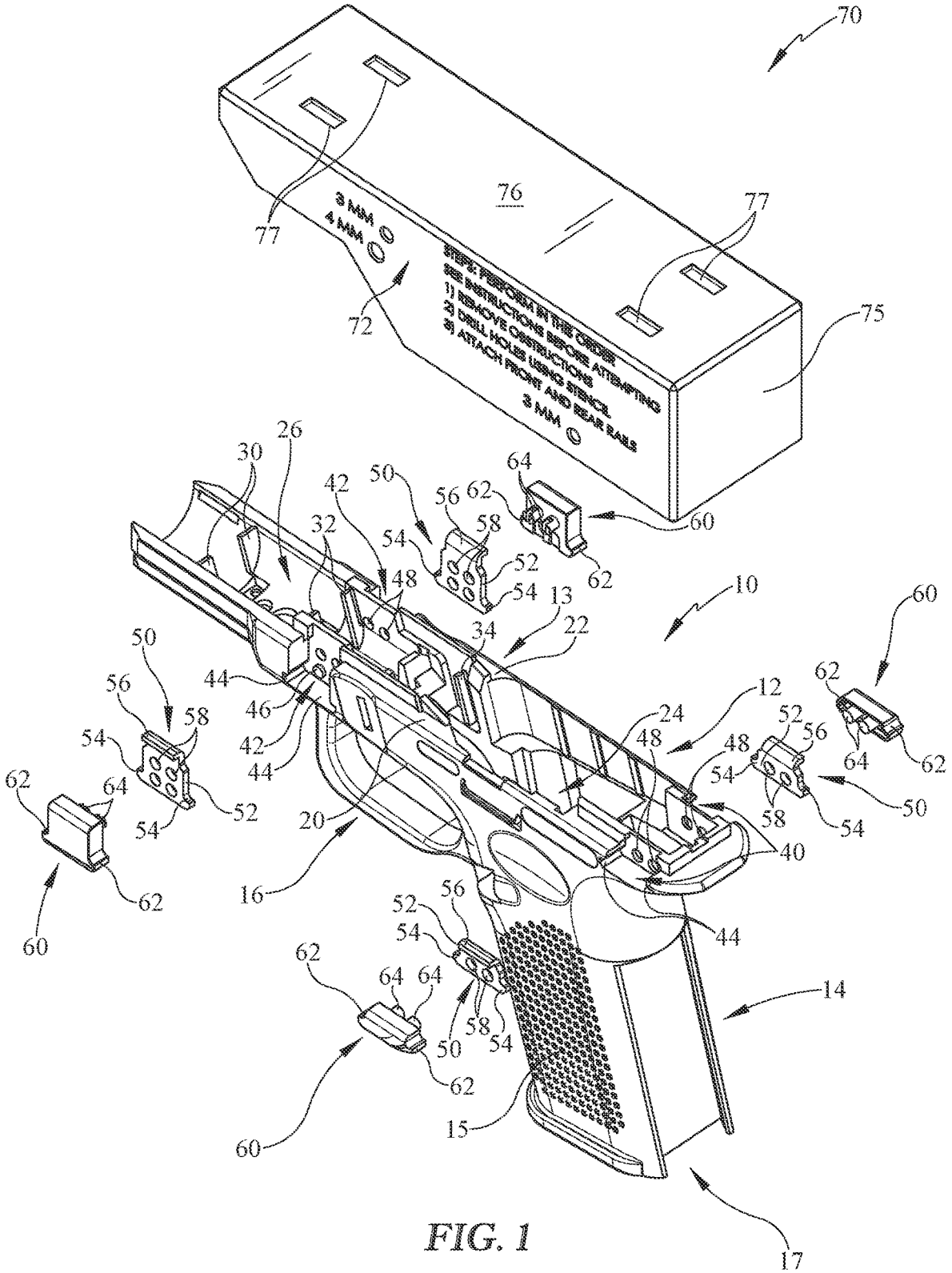
FIG. 1 is an exploded perspective view of an unfinished firearm frame and a stencil for use in finishing the frame.

It is to be understood that an unfinished firearm is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to FIGS. 1-8, the instant unfinished frame provides for a component of a firearm which may be finished in a desired, customized manner, according to the desire of the firearm owner. The unfinished frame, frame subassembly, and a stencil allow for construction or finishing of the frame subassembly components to a finished frame so that upon completion, the remainder of the firearm may be constructed.

Referring now to FIG. 1, a perspective view of an unfinished firearm frame, also referred to as a frame subassembly, 10 is depicted. The unfinished frame 10 comprises a body 12 having a grip 14, and a trigger guard 16. The body 12 comprises an upper portion 13 adjacent to which a slide 90 (FIG. 2) may be positioned after further machining and/or manufacturing tasks are completed. The upper portion 13 extends longitudinally from a forward end of the unfinished frame 10 toward a rearward end. It should be understood that the frame 10 is unfinished until the components of the frame 10 are installed and the slide 90 may be added and fired. Once finished, some portions of the unfinished firearm 10 may be removed and others may be added for proper function and operation.

The grip 14 may include texturing or knurling 15 to improve purchase of the user's hand when handling the frame 10. The interior of the grip 14 may define a magwell 17 wherein a magazine (not shown) with cartridges is received for firing operation, once the unfinished firearm frame 10 is machined and finished.

The upper portion 13 of the body 12 may be defined generally by a first sidewall 20 and a second sidewall 22 which extend in a longitudinal direction and generally vertically and parallel to one another. The sidewalls 20, 22 generally extend between the front and rear of the unfinished frame 10. Between the sidewalls 20, 22 are one or more receptacles 24, 26. For example, there may be a forward receptacle 26 and a rearward receptacle 24.

The forward receptacle 26 may be formed to receive a rod 94 (FIG. 2) and a recoil spring (not shown). However, there may be one or more removable obstructions 30, 32, 34, within the receptacle 26 which preclude seating of the rod and spring, or preclude sliding of the slide, or some combination thereof. In the instant embodiments, the removable obstructions 30, 32, 34 may be positioned to accept the rod and spring but preclude function of the slide (not shown) until some or all of the removable obstructions 30, 32, 34 are removed, after some machining work described further herein. Stated otherwise, the unfinished firearm frame 10 may include obstructions which preclude positioning of parts, proper function, or both. The obstructions 30, 32, 34 are disposed along the sidewalls 20, 22 and may extend partially or fully between the sidewalls 20, 22. As depicted, the instant obstructions 30, 32, 34 are shown extending only partially so that a guide rod 94 (FIG. 2) and recoil spring may be seated there between but may preclude sliding motion.

The frame 10 may also include pockets 40, 42. In some embodiments, the pockets 40, 42 may be disposed in the sidewalls 20, 22 and adjacent to a respective receptacle 24, 26. For example, the frame 10 may include a first pair of pockets 40 toward the rear of the frame 10 and adjacent to a rear receptacle 24 and a second pair of pockets 42 toward the front of the frame 10 adjacent to the front receptacle 26.

The frame 10 may also comprise a second pair of pockets 42 which in some embodiments may be located toward the forward end of the body 12 and adjacent to a forward receptacle 26. The pockets 40, 42 may each comprise a first shape of a first dimension and a second shape of a different dimension. In the example the first and second dimensions extend in the same width direction so that one dimension of each pocket 40, 42 is wider than the other. For example, the pockets 40, 42 may have a square or rectangular shape of a first width and a second width with is greater than the first width and which defines a keyway 44. The keyway 44 may have a locating function as well as a retention function in a vertical direction for slide rails 50 and the caps 60.

Each interior surface of each pocket 40, 42 may comprise one or more locating pin 46 or apertures 48. These cooperate with other locating features to properly locate other parts during the finishing process of the frame.

Exploded from each pocket 40, 42, there may be a slide rail 50. The slide rail 50 may have a slide body 52 with at least one key 54 that aligns with the keyways 44 of the pockets 40, 42. The at least one key 54 locates the slide rail 50 relative to the pockets 40, 42. Further the key 54 may also retain the slide rail 50 within the pockets 40, 42. The slide rail 50 may also comprise a slide lip 56 which may be defined by an edge or a rolled surface, for non-limiting example. The slide lip 56 supports a slide (not shown) when positioned on the finished frame.

The slide rail 50 may comprise the other of one or more corresponding pins or apertures 58. The pins or apertures 58 may align with the cooperating pins 46 or apertures 48 of the pockets 40, 42 so that the slide rails 50 are located in a desired location of the pockets 40, 42. Once the slide rails 50 are located in pockets 40, 42, the slide rails are retained in two dimensions—the front-rear direction of the frame 10 and the vertical direction.

Disposed outwardly of each slide rail 50 is a cap 60. The cap 60 is also shaped similarly to the pocket 40 so that the cap 60 includes at least one key 62 that aligns with the keyway 44 of the pockets 40, 42. The cap 60 may also comprise one or both or alignment pins 64 or apertures that cooperate with the slide rail 50. In this way, the cap 60, slide rail 50 and pocket 40, 42 are all engaging by the interconnection of keys 62, 54 keyways 44, pins 46, and apertures 48. After installation of the caps 60, the slide rails 50 are retained in three directions. Accordingly, with the parts 50, 60 located, the three parts 12, 50, 60 may be epoxied or adhered together in some form during the finishing or construction necessary to convert the frame from an unfinished frame 10 to an operational frame.

Additionally, the rear area of the frame 10 may comprise rear pockets 40. The rear pockets 40 may similarly have an opening with an additional one or more keyways 44. Exploded from the rear pockets 40 may be slide rails 50. The pockets 40 may include one or more pins or apertures 46, 48 to locate the slide rails 50 relative to the pocket. The slide rails 50 may also include the at least one key 54 which cooperates with a keyway 44 defined by the pocket. A cap 60 is also shown to capture the slide rail in the pocket. The cap 60 may include a key 62 to cooperate with the keyway 44 and pins or apertures 46, 48 which function with the slide rail 50 and/or pocket 40 for locating the parts. The cap 60, slide rail 50 and pocket 40 may be adhered with an adhesive or epoxy to retain the parts in position, as part of the completion of the frame 10.

Figure 2:
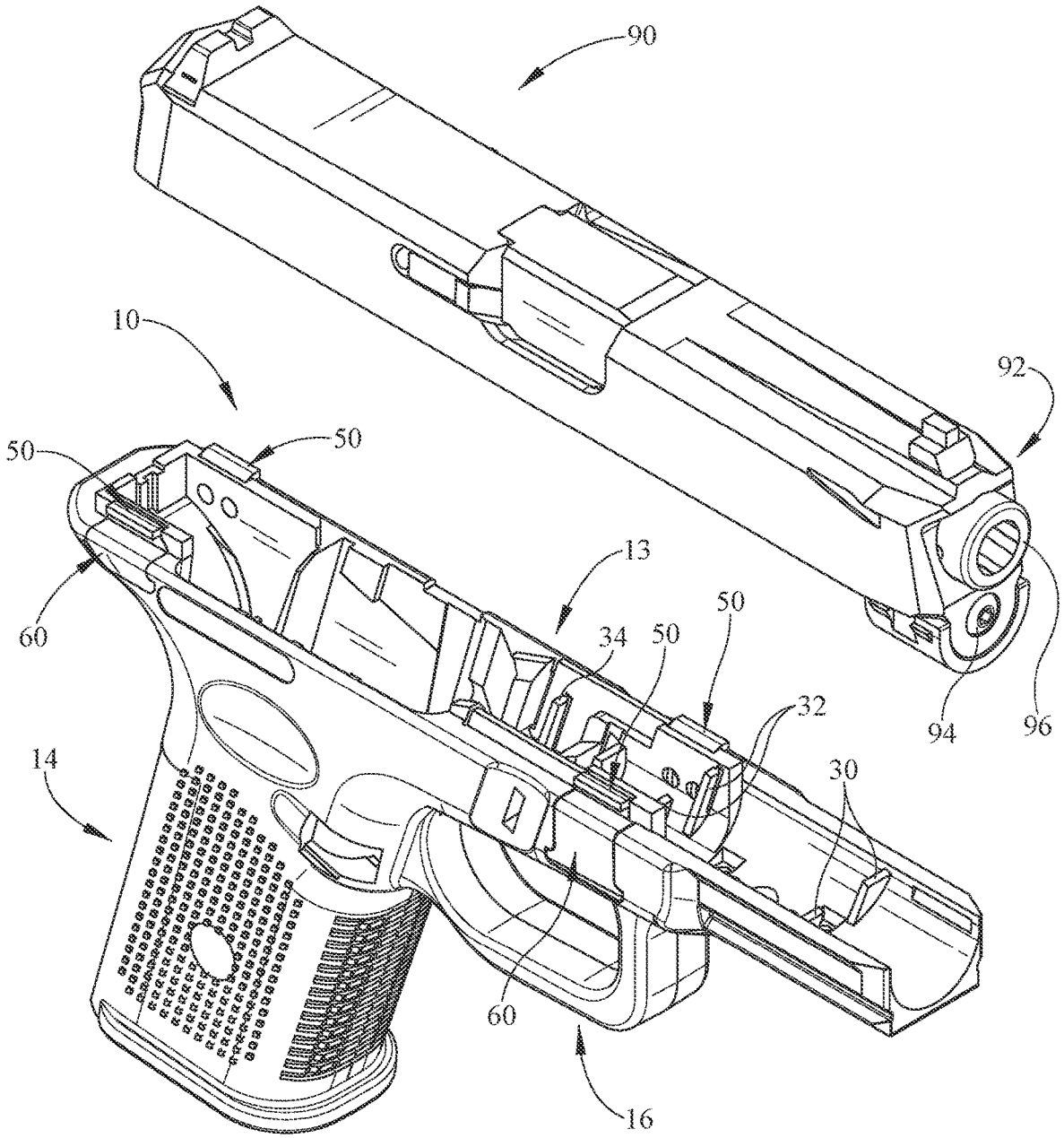
FIG. 2 is a perspective view of the assembled firearm frame with a slide exploded from the frame.

Referring now to FIG. 2, the unfinished frame 10 is shown in perspective view. In this view, the caps 60 are installed with the slide rails 50. During further construction of the firearm, a slide 90 may be applied to the slide rails 50 for movement during the firing sequence. However, before that can happen further finishing should occur to the frame 10. Further, once the frame 10 is finished, the user will also add a trigger assembly within the receptacle between the first and second sidewalls 20, 22 (FIG. 1).

Also shown in this view is the slide 90. Since the obstructions 30, 32, 34 are still shown in the frame 10, the slide 90 cannot be installed or operated. The slide rails 50 extend above the upper portion 13. The slide 90 moves along the slide rails 50 and is constrained to longitudinal movement. The slide 90 is biased toward a forward direction of the frame 10 once finished and installed, but is forced rearward when the gun is fired by the blast of each cartridge. The slide 90 then returns forward under spring bias of the recoil spring.

The slide 90 also houses a barrel 96 at a forward end 92 thereof. The barrel 96 extends rearward. Also shown at the forward end 92 is a guide rod 94. The recoil spring is disposed over the guide rod 94 but is not seen in this view. The spring forces the slide 90 forward after the slide 90 recoils from a blast.

Figure 3:
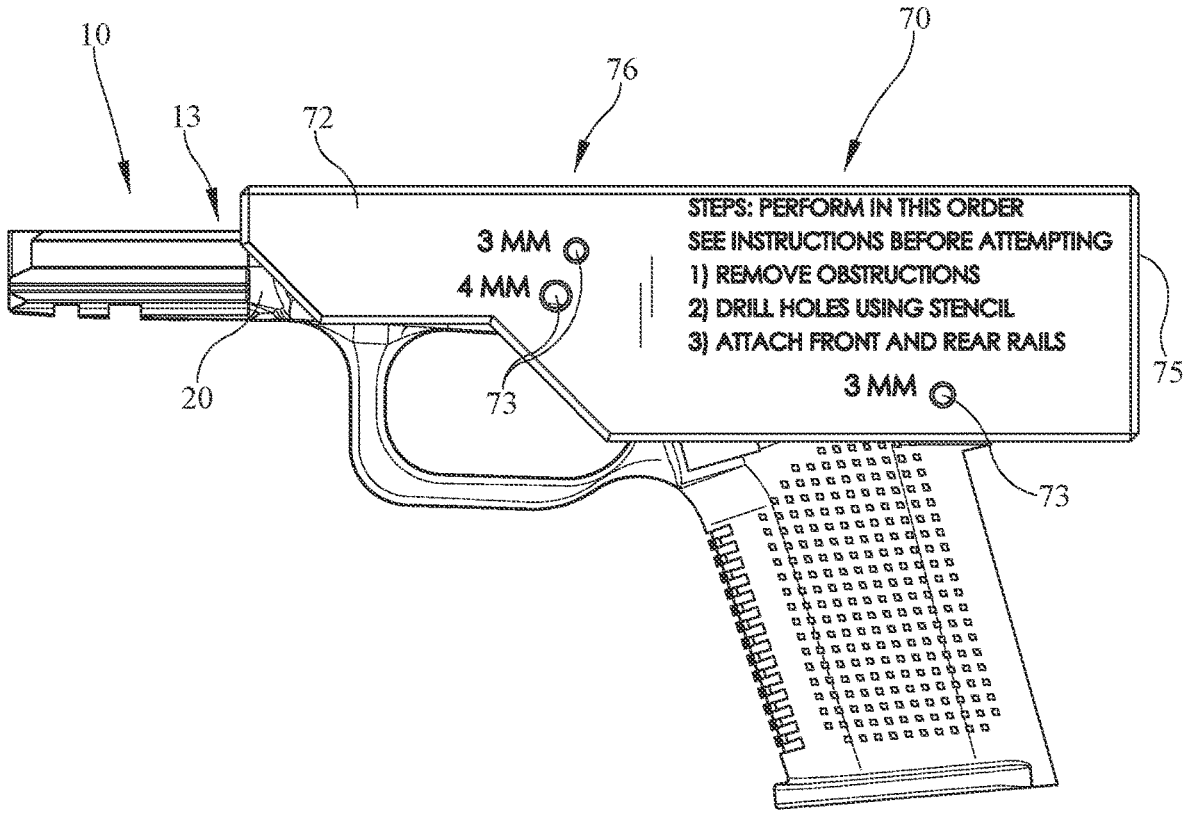
FIG. 3 is a side view of the unfinished frame and a stencil positioned for drilling.

With reference now to FIG. 3, a side view of the unfinished frame 10 is depicted. In this view, the frame 10 is shown with a stencil 70 on the upper portion 13 of the unfinished frame. The stencil 70 may be defined by a first wall 72 and a second parallel wall 74 (FIG. 4), with a joining wall 76 extending between the first and second walls 72, 74. The stencil 70 may also comprise a rear wall 75. The area between the joining wall 76, the first and second walls 72, 74, and the rear wall 75 is mostly hollow so that the upper portion 13 of the unfinished frame 10 may be received therein.

The stencil 70 is used as a guide for drilling holes such as a trigger pin hole and others, for example fire control housing and/or locking block, or other structures or assemblies to be locked in the frame during construction. The stencil 70 may be applied in the manner shown prior to the slide rails 50 and caps 60 being applied to the pockets 40. The stencil 70 may include lugs 78 (FIG. 5) on an inner surface of either the joining wall 76 or the side walls 72, 74, which correspond to the pockets 40, 42 on the unfinished frame. The lugs 78 serve to locate the stencil 70 on the frame 10 when positioned in the manner shown.

The stencil 70 may also include through holes 73 for locating a drill bit or other machining tools. The through holes 73 are located along the first sidewall 72 and the second sidewall 74 such that when the stencil 70 is positioned, the through holes 73 are disposed at locations relative to the unfinished frame 10 so that holes may be drilled in the frame 10.

Figure 4:
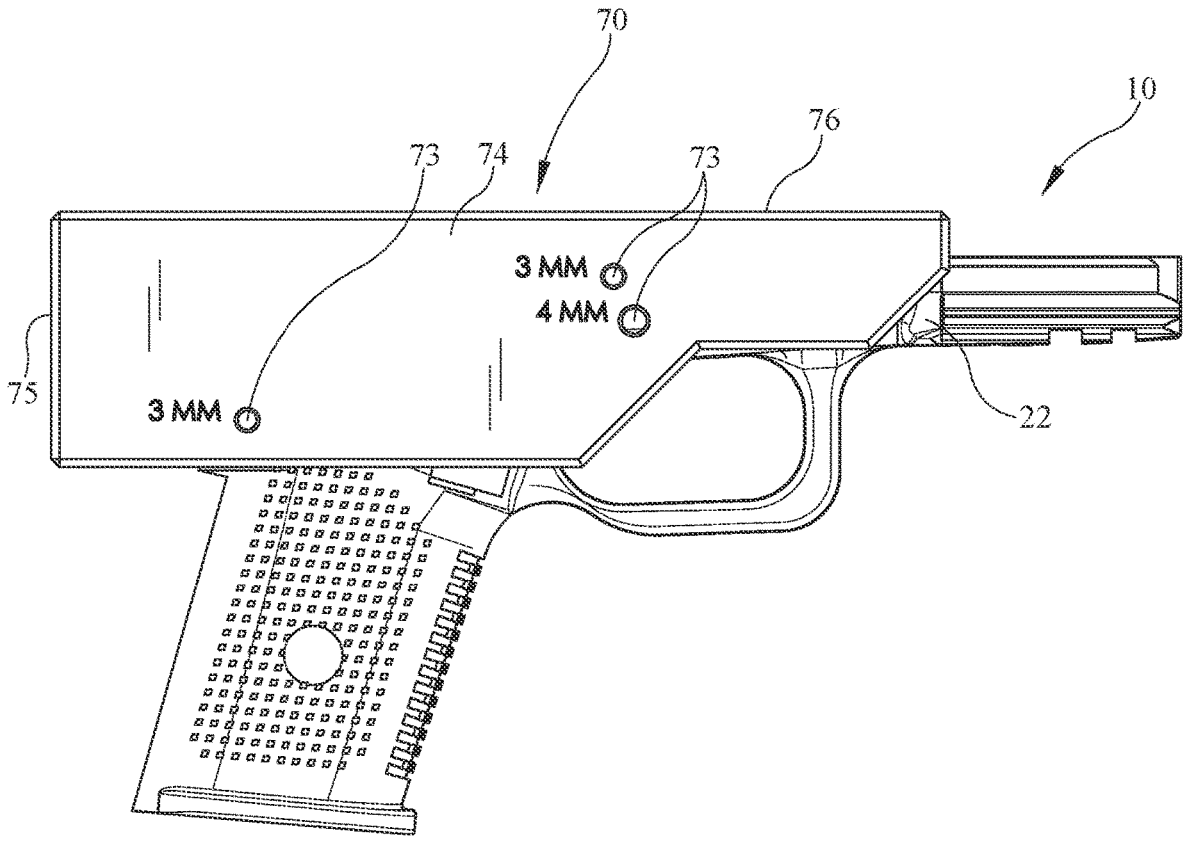
FIG. 4 is a second side view of the configuration of FIG. 3.

The holes 73 may be drilled on each sidewall 20, 22 as shown with additional reference to FIG. 4. Pins or other fasteners may be positioned in these drilled through holes during further construction of the firearm, for example for installation of a trigger assembly or fire control assembly.

Figure 5:
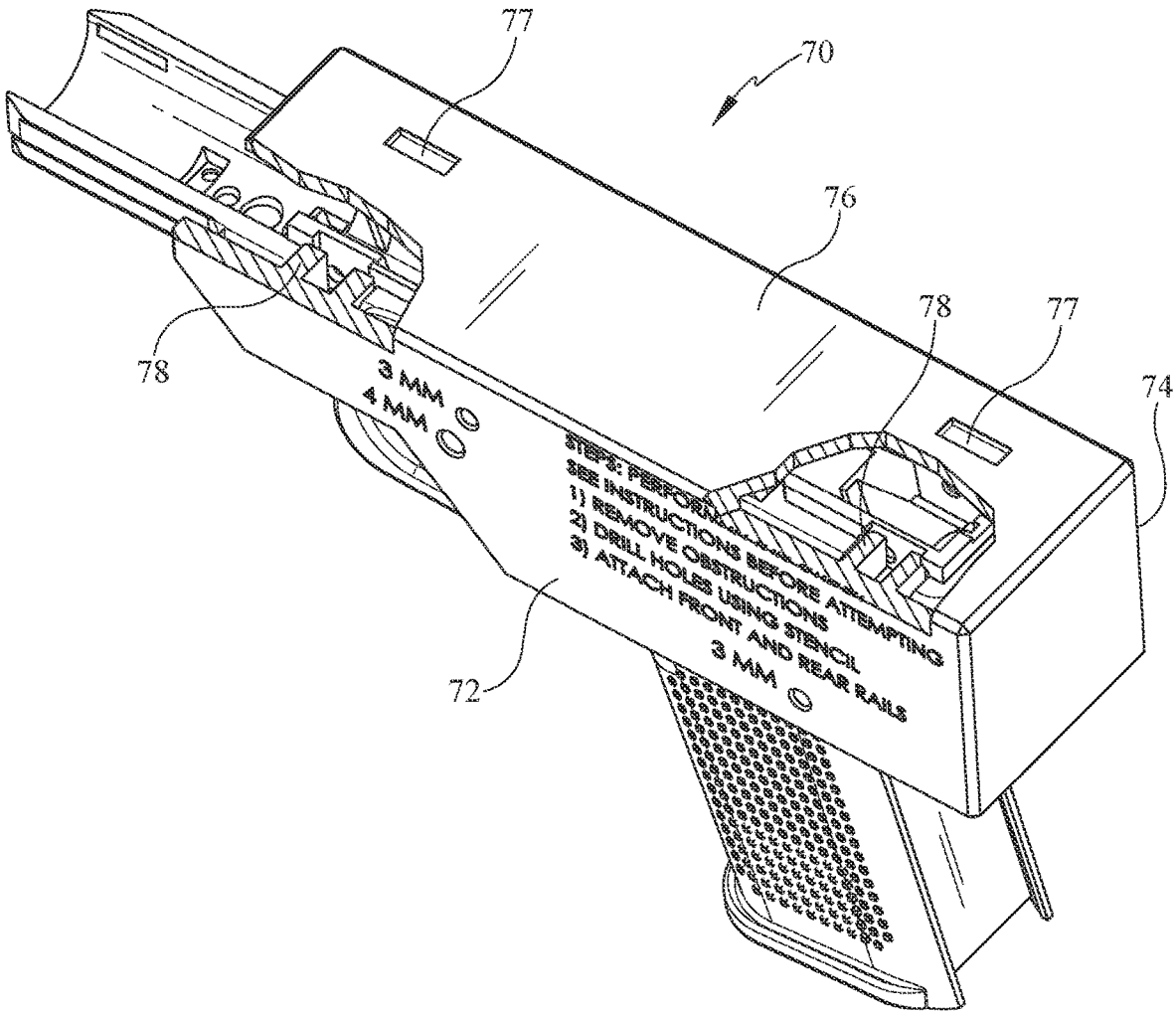
FIG. 5 is a perspective view of the arrangement of FIGS. 3 and 4, with cutaway portions to reveal method of mounting the stencil.

As shown in FIG. 5, the stencil 70 is shown with portions of the joining wall removed. In this view, the lugs 78 are shown on the inside area of the stencil 70 and disposed within the pockets 40, 42 of the unfinished frame 10. The lugs 78 may extend from the sidewalls 72, 74 horizontally, or may extend vertically from the top wall 76.

Figure 6:
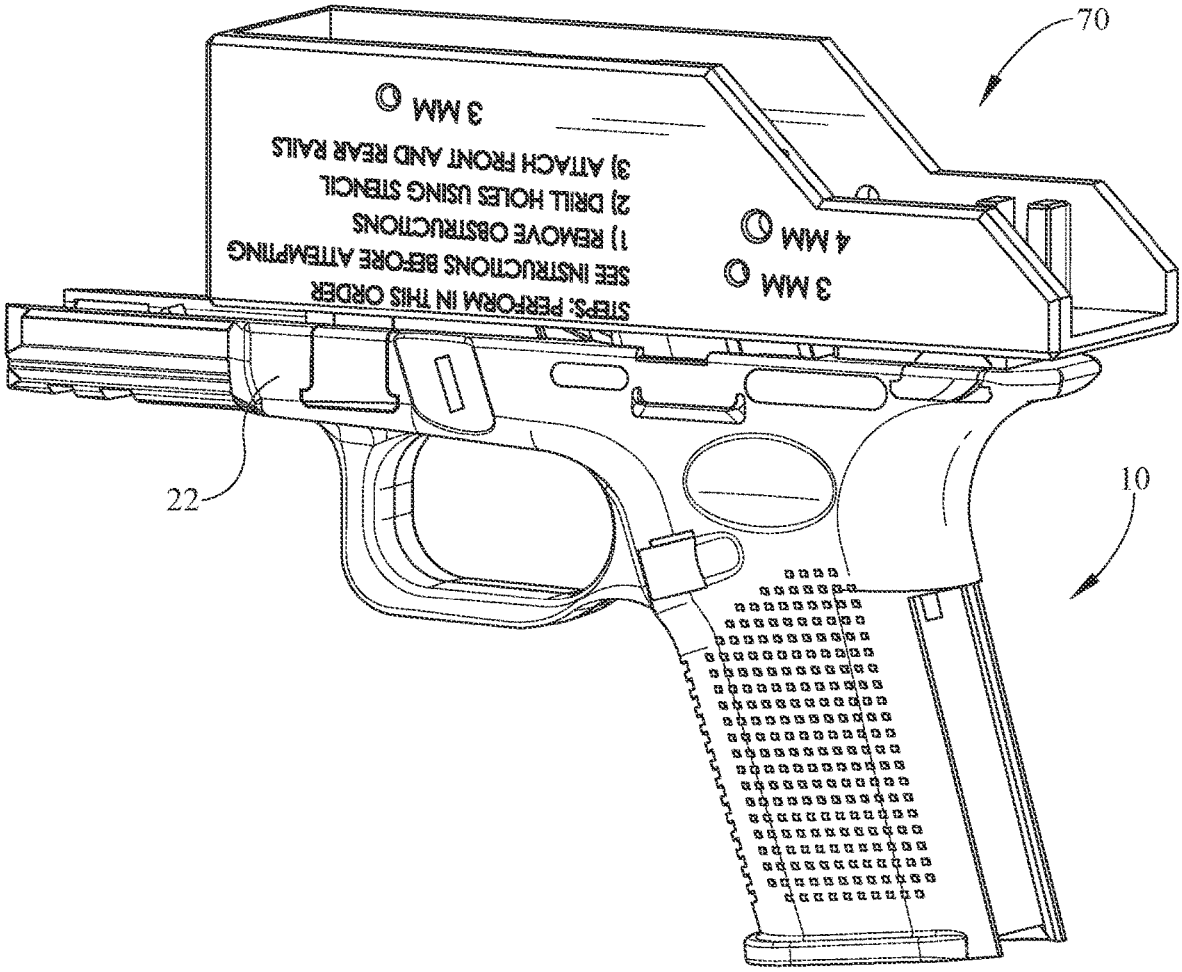
FIG. 6 is a perspective view of the unfinished frame with the stencil reversed.

After the through-holes are formed in the unfinished frame 10, the slide rails 50 may be installed. With reference to FIGS. 1 and 6, an upper surface of the joining wall 76 may also include divots or other locating features 77 thereon. The divots 77 are shown to extend only partially into the upper surface of the joining wall 76, but may extend through in some embodiments. As shown in the FIG. 6, the stencil 70 is disposed on the frame 10 such that the divots 77 are located proximate to the location of the slide rails 50, when the slide rails 50 are installed and epoxied or other adhesive is used. Accordingly, FIG. 6 shows the stencil 70 disposed in an upside down orientation from its position of FIGS. 3-5.

Once the stencil 70 is inverted and pressed against the slide rail 50, pressure may be applied to the stencil 70 or from the frame 10 against the stencil 70. In either manner, the stencil 70 is used to apply pressure during the curing process of the adhesive.

Figure 7:
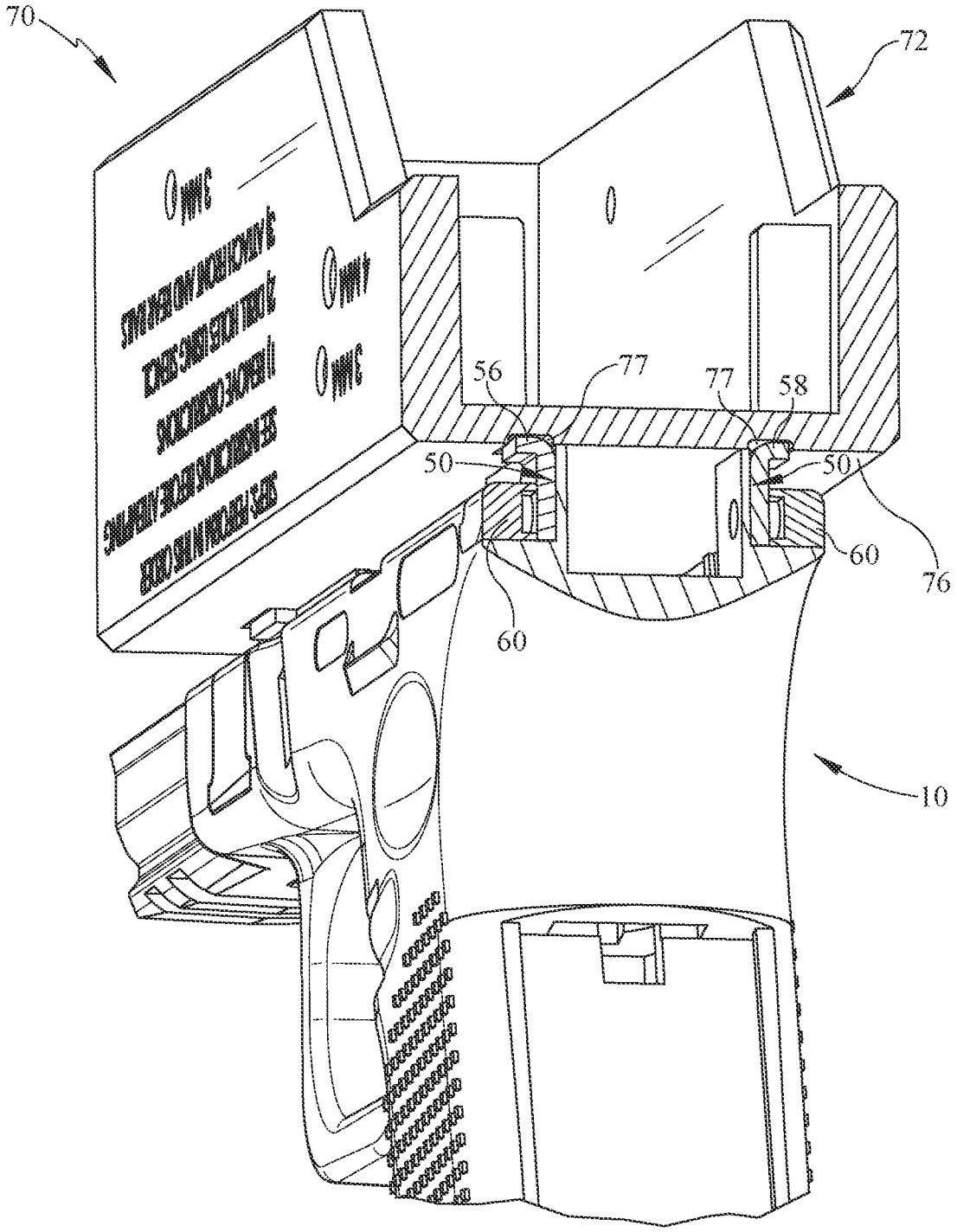
FIG. 7 is a rear detail perspective view of the configuration of FIG. 6; and, FIG. 8 is a set of method steps related to the unfinished firearm frame.

With reference to FIG. 7, a perspective section view of the frame 10 and the stencil 70 is shown. The divots are located to receive the slide rails. In this way, the pressure may be applied to the stencil and the adhesive cured. The stencil 70 may be secured, taped, or otherwise retained in position for this curing process.

As previously referenced, the unfinished frame 10 is formed with obstructions 30, 32, 34 which need to be removed during the finishing or construction process. With reference again to FIG. 1, the obstructions 30, 32, 34 are formed with the frame 10, for example during a molding process. The obstructions 30, 32, 34 may be removed in a variety of manners, for example by cutting for example with a knife or razor blade, by abrasive such as sandpaper or a roto-tool with abrasive bit, or other means. The obstructions 30, 32, 34 may function in a variety of ways, but in some embodiments preclude operation of a slide. For example, the size of the obstructions depending on the desired function. In some embodiments, the size of the obstructions 30, 32, 34 may allow for positioning of the recoil spring and guide rod. However, in other embodiments, the obstructions 30, 32, 34 may preclude their insertion. In the instant embodiment shown, the size allows for insertion of the guide rod 94 (FIG. 2) and recoil spring, but precludes operation of the slide. Once the obstructions 30, 32, 34 are removed, the slide may function.

Figure 8:
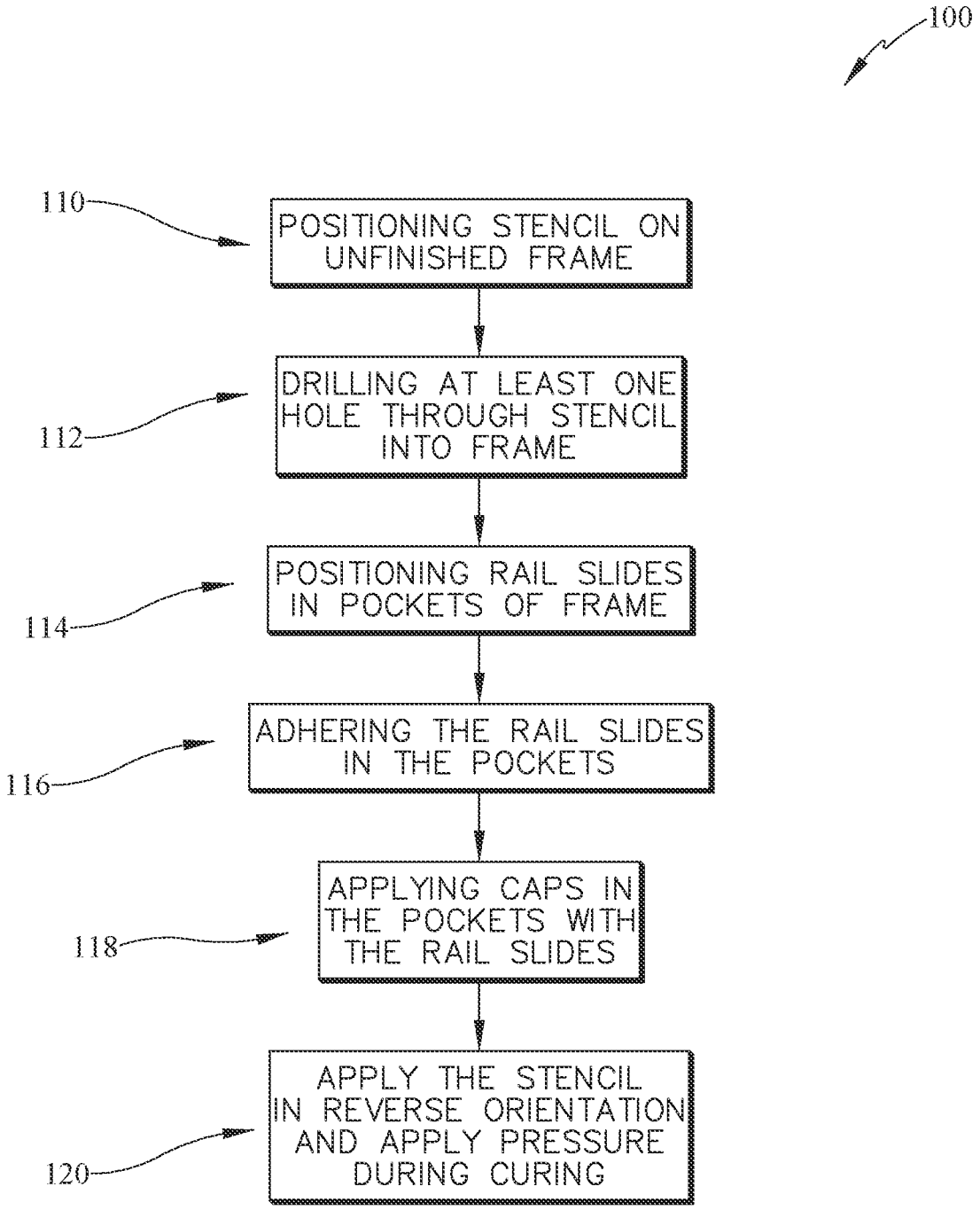

Referring now to FIG. 8, a set of steps are shown for a method of finishing the unfinished firearm frame 10. In the method 100, a first step comprises placing a stencil on the unfinished frame at step 110. Next, at least one hole is drilled through the stencil 70, at step 112.

At step 114, the rail slides 50 may be positioned in the pockets 40, 42. The number of rails slides and pockets may vary. The rail slides 50 and pockets 40, 42 may be located by locating features such as key, keyways, pins, and apertures or other locating features. At step 116, the rail slides 50 may be adhered within the pockets 40, 42 for example by adhesive or epoxy. The epoxy or adhesive may be applied before or after the rail slides are fully seated in the pockets. The adhesive may be applied within the pocket or on the rails slides, or both.

Next, at step 118, the caps 60 may also be applied to the pockets. This may occur when the rail slides are being epoxied. It may be desirable to position the caps in the pockets when the adhesive is wet and uncured. Adhesive may also be applied to the cap 60 to improve adherence.

After the caps 60 and slide rails 50 are in position, the adhesive may be cured. At step 120, the stencil may be applied to the upper lips of the slide rails such that the divots 77 engage the slide rails 50. Once positioned, pressure may be applied to the stencil 70 or against the stencil from the frame 10 so that the slide rails are held in proper position during curing. Once cured, a trigger assembly may be added to the frame 10 and a slide, barrel, guide rod, and spring all added to finish the firearm.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. An unfinished frame subassembly, comprising:

a body including a grip, a trigger guard, and an upper portion capable of receiving a slide upon further machining adjacent to an upper edge of said upper portion;

the upper portion including a forward portion having a forward receptacle and a rearward portion having a rearward receptacle;

a first pair of pockets disposed adjacent to said rearward receptacle, each pocket of said first pair of pockets capable of receiving a rear slide rail;

a second pair of pockets disposed adjacent to said forward receptacle, each pocket of said second pair of pockets capable of receiving a forward slide rail;

a cap which is disposed in each of said pockets, said cap retaining each of said rear and forward slide rails.

2. The unfinished frame subassembly of claim 1, one of said pockets or said rear and forward slide rails having one or more locating apertures.

3. The unfinished frame subassembly of claim 2, the other of said pockets or said rear and forward slide rails having one or more locating pins corresponding to said one or more locating apertures.

4. The unfinished frame subassembly of claim 1, each of said pockets having a first width and a second width defining a keyway.

5. The unfinished frame subassembly of claim 4, said second width receiving keys of each of said slide rails, to limit vertical motion of said rear and forward slide rails, when disposed in each of said pockets.

6. The unfinished frame subassembly of claim 1, said forward receptacle having one or more removable obstructions.

7. The unfinished frame subassembly of claim 6, said one or more removable obstructions of said forward receptacle configured to allow receipt of a guide rod and recoil spring.

8. The unfinished frame subassembly of claim 7, said one or more removable obstructions inhibiting installation or operation of the slide.

9. The unfinished frame subassembly of claim 1, said subassembly requiring fabrication in order to function.

* * * * *